US005496186A

United States Patent [19]

Dobbelaere et al.

[11] Patent Number: 5,496,186

[45] Date of Patent: Mar. 5, 1996

[54] ELECTRIC PLUG CONNECTOR

[75] Inventors: Joris Dobbelaere, Beernem; Artur Wohlfart, Bad Durkheim, both of Germany

[73] Assignee: Siemens Aktiengesellschaft, Munich, Germany

[21] Appl. No.: 317,197

[22] Filed: Oct. 3, 1994

[30] Foreign Application Priority Data

Oct. 1, 1993 [DE] Germany ..... 43 33 605.1

[51] Int. Cl.[6] ..... H01R 13/62

[52] U.S. Cl. ..... 439/157; 439/155

[58] Field of Search ..... 439/152–160, 439/372

[56] References Cited

U.S. PATENT DOCUMENTS

| | | | |
|---|---|---|---|
| 4,152,038 | 5/1979 | Inouye et al. | 439/157 |
| 4,893,405 | 1/1990 | Pennington | 439/160 |
| 5,010,426 | 4/1991 | Krenz | 439/157 |

FOREIGN PATENT DOCUMENTS

| | | |
|---|---|---|
| 2812901 | 9/1978 | Germany . |
| 8714016 | 11/1987 | Germany . |

*Primary Examiner*—David L. Pirlot

*Attorney, Agent, or Firm*—Herbert L. Lerner; Laurence A. Greenberg

[57] ABSTRACT

An electric plug connector includes first, second and third housing parts. One of the housing parts is a plug receptacle for receiving a contact element and forming a plug channel. Another of the housing parts is a plug for receiving a complementary contact element and having outer contours adapted to the plug channel. A further of the housing parts is an actuation element in the form of a longitudinally movably guided slide for moving the plug into and out of the plug receptacle. Three sets of teeth are each disposed on a respective one of the housing parts and have a predetermined gear ratio. Two of the sets of teeth are racks each being firmly connected to a respective one of the first and second housing parts. One of the sets of teeth is a gear wheel being rotatably supported on the third housing part for meshing with the two racks.

8 Claims, 4 Drawing Sheets

ELECTRIC PLUG CONNECTOR

BACKGROUND OF THE INVENTION

1. Field of the Invention

The invention relates to an electric plug connector having two housing parts with complementary contact elements, wherein one housing part is a plug receptacle forming a plug channel and the other housing part is a plug being adapted in its outer contours to the plug channel, and having an actuation element which, upon actuation through a set of gear teeth with a predetermined gear ratio, moves: the plug into or out of the plug receptacle.

In order to connect and release plug connectors, strong forces must often be exerted, especially in the case of a multi-pin plug connector. That becomes a problem especially if a stationary housing part, that is the plug receptacle, is disposed at a poorly accessible location, as can be the case in motor vehicles, for instance. In order to assure a secure connection, it is important that the contact elements of the two plug connector parts be made to mesh completely with one another, or in other words that the plug be pressed all the way into the plug receptacle. In order to assure that and also to prevent unintentional undoing of the plug connection, insertion and pulling aids of various forms are used.

It is known to employ a gear ratio or mechanical advantage in plug connectors. For instance, German Utility Model DE-U 87 14 016 describes an electrical connector housing in which a lever is supported in the gap between the plug and the plug receptacle on the plug. A short lever arm of the lever comes to mesh with a rack of the plug receptacle through a tooth. In a plug connector known from German Published, Non-Prosecuted Application DE 28 12 901, two levers are supported on the plug receptacle and each comes to engage a rack of the plug through a pinion on the short lever arm. In both cases, the geometry of the lever arm fixes and also limits the gear ratio constantly over the entire insertion path. Such plug connectors are moreover not universally usable due to the space required for the pivoting motion of the lever.

SUMMARY OF THE INVENTION

It is accordingly an object of the invention to provide a plug connector, which overcomes the hereinafore-mentioned disadvantages of the heretofore-known devices of this general type and which does so in such a way that locking of two housing parts with an insertion force mechanical advantage or gear ratio is made possible, without having to use a pivoting lever. A gear ratio should be freely selectable within a wide range, and should also be adaptable as much as possible to changing force conditions over the course of an insertion path.

With the foregoing and other objects in view there is provided, in accordance with the invention, an electric plug connector, comprising first, second and third housing parts; one of the housing parts being a plug receptacle for receiving a contact element, the plug receptacle: forming a plug channel; another of the housing parts being a plug for receiving a complementary contact element, the plug having outer contours adapted to the plug channel; a further of the housing parts being an actuation element in the form of a longitudinally movably guided slide for moving the plug into and out of the plug receptacle; and three sets of teeth or toothing each being disposed on a respective one of the housing parts and having a predetermined gear ratio, two of the sets of teeth being racks each being firmly connected to a respective one of the first and second housing parts, and one of the sets of teeth being a gear wheel being rotatably supported on the third housing part for meshing with the two racks.

In contrast to the known insertion force mechanical advantages or gear ratios, in each of which a swiveling lever on one lever arm has a permanently connected tooth or a permanently connected pinion, in the invention a freely rotatable gear wheel is accordingly provided, which forms a step-up gear with two racks that are linearly displaceable counter to one another. The actuation element no longer needs to be pivotably supported but instead can be longitudinally movable in the insertion direction, which makes an adaptation to tight space conditions possible with accessibility only in the insertion direction.

In principle, the gear wheel can be provided at each of the three parts that are displaceable parallel to one another, that is the plug receptacle, the plug and the slide. The only critical factor is to convert the longitudinal motion of the slide, through the set of gear teeth, into a longitudinal motion of the plug. As a rule, in order to lower the forces of insertion and pulling, the travel of the slide is longer than the travel of the plug.

In accordance with another feature of the invention, the gear wheel is supported on the plug, so that it meshes with a rack of the plug receptacle and a rack of the slide, with these two racks preferably being disposed on both sides of the gear wheel axis. In this way with a gear wheel that uses a single toothed ring to mesh with both racks and has the same tooth pitch, an insertion advantage of 1:2 is already achieved, since the plug that carries the gear wheel travels only half the distance of the slide provided with a rack.

In accordance with again another feature of the invention, in order to attain a different gear ratio, the gear wheel has two toothed rings of different pitch. However, in that case one toothed ring would mesh with the rack of the plug receptacle and the other toothed ring would mesh with the rack of the slide.

In accordance with a further feature of the invention, the gear wheel is supported on the slide and meshes with a rack of the plug receptacle and a rack of the slide, and these racks extend parallel, preferably on the same side of the gear wheel axis. In order to attain a mechanical advantage or gear ratio in this case, the racks and/or the gear wheel are provided with two toothed rings which must have different pitches.

In accordance with again a further feature of the invention, the gear ratio is also provided by a pitch that varies differently over the course of the insertion motion and is thus adapted to the various insertion forces. It may, for instance, be provided for the gear ratio to be low as long as only the housing parts are inserted into one another, and to become greater when, at the end of the insertion motion, all of the contact elements are in engagement with one another and strong insertion forces are therefore required.

In accordance with an added feature of the invention, in order to prevent unintended undoing of the plug connection, detent elements meshing with one another are provided on the plug receptacle on one hand and on the slide or plug on the other hand, which elements lock the housing parts relative to one another at the end of the insertion motion.

In accordance with an additional feature of the invention, there is provided an additional slide having a set of teeth, the sets of teeth of the slides being disposed on opposite sides of the housing parts.

In accordance with a concomitant feature of the invention, there is provided a yoke interconnecting the slides.

Other features which are considered as characteristic for the invention are set forth in the appended claims.

Although the invention is illustrated and described herein as embodied in an electric plug connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
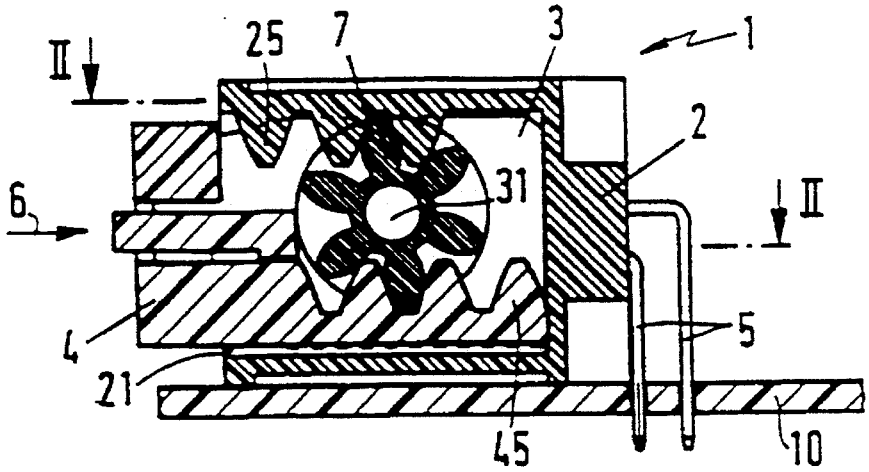
FIG. 1 is a diagrammatic, partly longitudinal-sectional view of a plug connector accommodated according to the invention, which is taken along a line I—I of FIG. 2, in the direction of the arrows.

Referring now to the figures of the drawing in detail and first, particularly, to FIG. 1 thereof, there is seen a plug connector 1 installed on a printed wiring board 10 with three parts of the plug connector, namely a plug receptacle 2, a plug 3 and a slide 4, being inserted all the way into one another. Contact elements and cable terminals in the plug are not visible or are not shown. Only two printed wiring board connection pins 5 illustrate a connection of the plug 1 to the printed wiring board 10. An insertion direction for the motion of the plug 3 and the slide 4 is indicated by an arrow 6.

The section in FIG. 1 is taken in such a way as to show an insertion channel 21 which is open toward the side and in which the inserted plug 3 becomes visible in a side view. A gear wheel 7 is rotatably supported laterally on this plug 3 and to that end, the plug 3 has a journal 31 on its lateral surface. The gear wheel 7 meshes on one side with a rack 25 of the plug receptacle 2 and on the other with a rack 45 of the slide 4.

Figure 2:
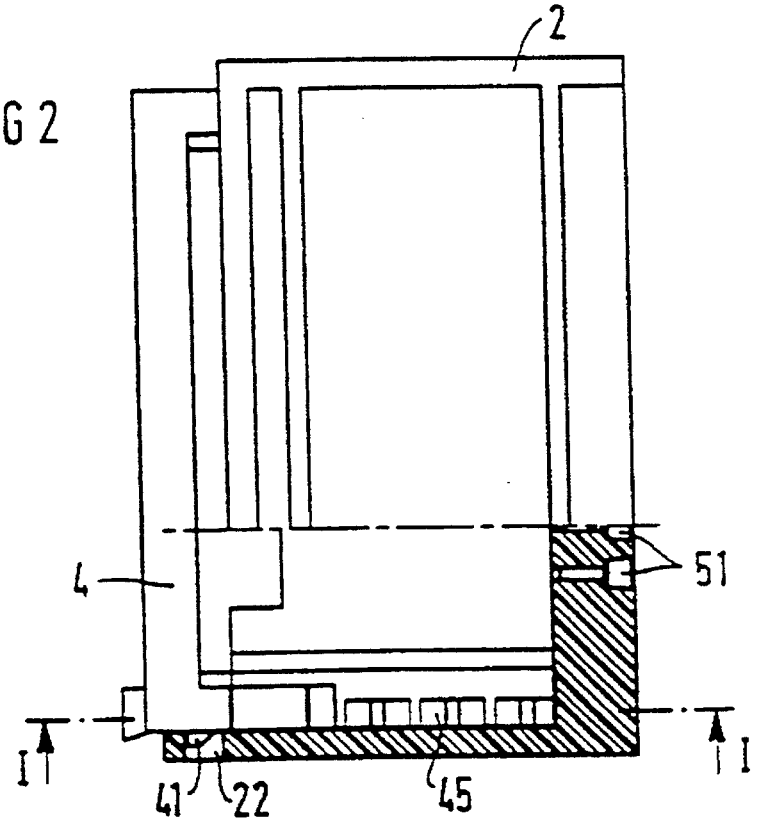
FIG. 2 is partly cross-sectional plan view of the plug connector which is taken along a line II—II of FIG. 1, in the direction of the arrows.
Figure 3:
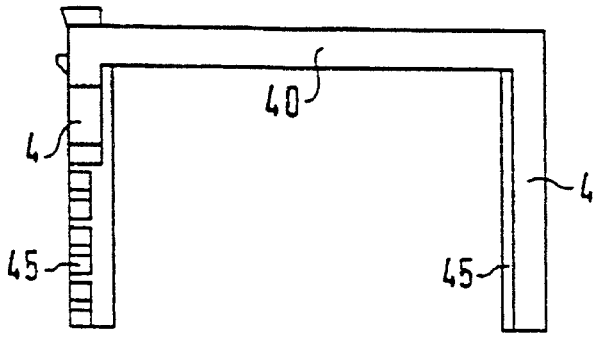
FIGS. 3 and 4 are elevational views of a slide of FIG. 1.
Figure 4:
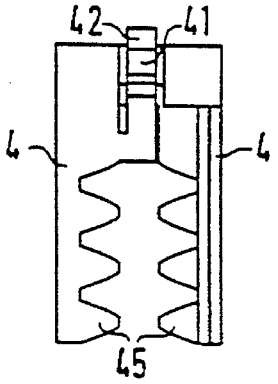
Figure 6:
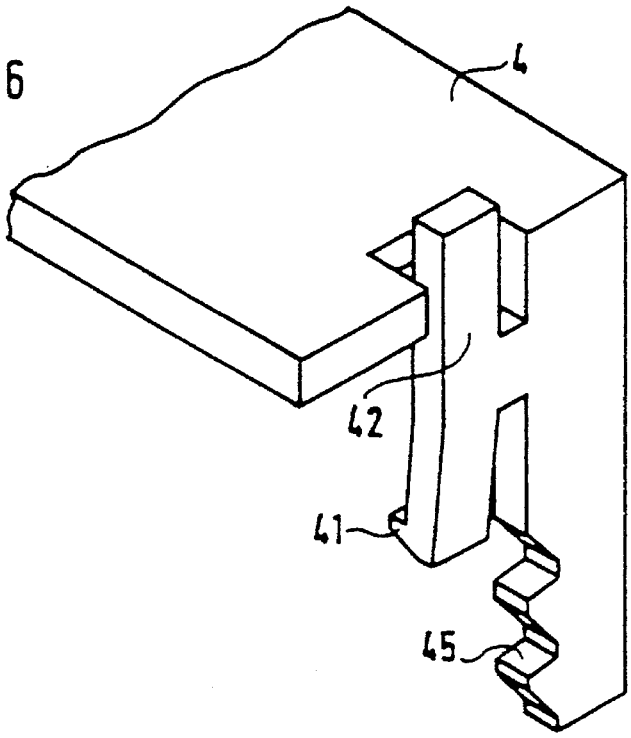
FIGS. 6 and 7 are fragmentary, perspective views of the slide with two different detent elements.
Figure 7:
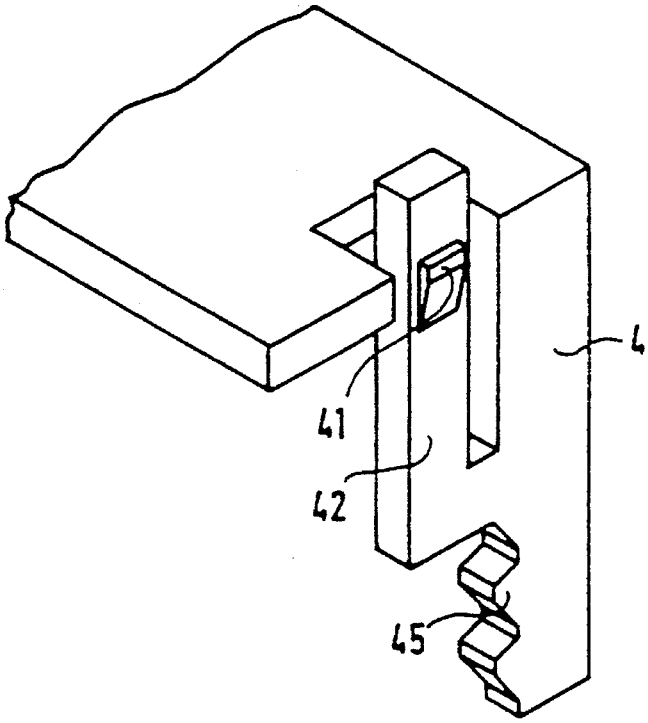

FIG. 2 shows the plug connector of FIG. 1 in a plan and partly sectional view, with the section being taken in such a way that in this region, the plug 3 with the gear wheel cannot be seen. The connection pins 5 and the printed wiring board 10 have also been left out of FIG. 2. Accordingly, only openings 51 for the connection pins have been suggested. In the interior of the plug receptacle 2, the rack 45 of the slide 4 can be seen, and an interlocking of the slide through a detent protrusion 41 in a recess 22 of the plug receptacle can also be seen. Two slides 4 are shown in two views in FIGS. 3 and 4. It can be seen that the two slides 4 are joined through a yoke 40 to make one common actuation element, and each of the slides 4 has one rack 45 in diagonally opposed regions of the plug. Accordingly, the plug 3 likewise has one gear wheel 7 on each of two opposed sides, and the plug receptacle 2 has one rack 25 on each of these opposed sides. In this way, by actuation of the yoke 40 through the two slides 4, the insertion force is generated symmetrically through the two sets of teeth. Moreover, the slide has one detent or locking protrusion 41 on each side, which interlocks with the recess 22 in the plug receptacle, as already noted. The detent or locking protrusion 41 is elastically joined to the respective slide 4 through a spring arm 42, so that the locking can be undone by bending the spring arm 42. The construction of the spring arm with the detent protrusion is shown in a perspective view in FIG. 7. FIG. 6 shows a modification in which the detent protrusion 41 is formed onto the underside of the spring arm 42. In that case, a corresponding non-illustrated detent recess must be provided at some other point of the plug receptacle.

Figure 5A:
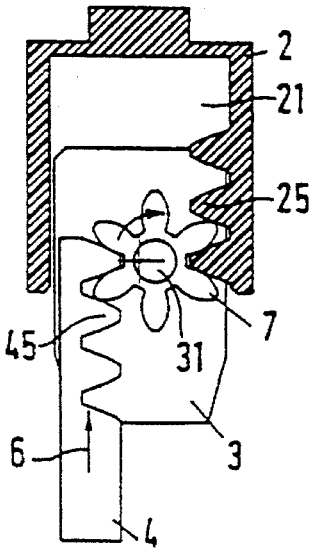
FIGS. 5*a*, 5*b* and 5*c* are partly sectional views of the plug connector of FIG. 1 in three successive phases of an insertion motion.
Figure 5B:
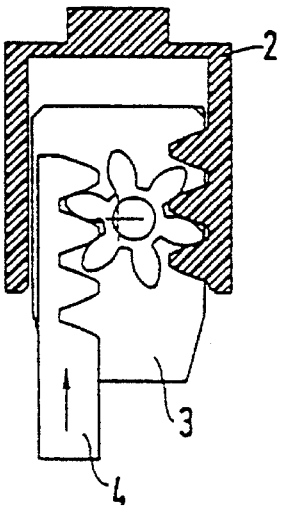
Figure 5C:
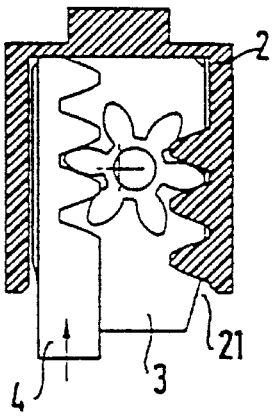

A mechanism of an insertion force mechanical advantage or gear ratio for the example described thus far is shown in FIGS. 5*a*–5*c*. It can be seen from these figures that the axis of the gear wheel 7, which is formed by the journal 31, is located in the middle between the two racks 25 and 45 of the plug receptacle 2 and the slide 4, wherein the racks are parallel and face one another. At the beginning of the insertion motion of the plug 3 into the plug channel 21, the gear wheel is in engagement with the outermost tooth of the rack 25 on one side and it is in engagement with the innermost tooth of the rack 45 on the opposite side, as is seen in FIG. 5*a*. When the slide 4 moves in the direction of the arrow 6, the gear wheel 7 is rotated clockwise. While it meshes with both racks 25 and 45, because of the journal 31 it likewise displaces the plug 3 in the direction of the arrow 6. However, the distance traveled is only half as long as the distance that the slide 4 travels. FIG. 5*b* shows a middle insertion position, while FIG. 5*c* shows a terminal position, in which both the plug 3 and the slide 4 are inserted all the way into the plug channel 21 of the plug receptacle 2. Since the tooth pitch of the gear wheel 7, like that of the racks 25 and 45, is the same, in this way the result is a gear ratio or mechanical advantage of the forces of 1:2 between the slide and the plug. At the end of the insertion motion, the slide is interlocked with the plug receptacle, in the manner already described above.

Figure 8C:
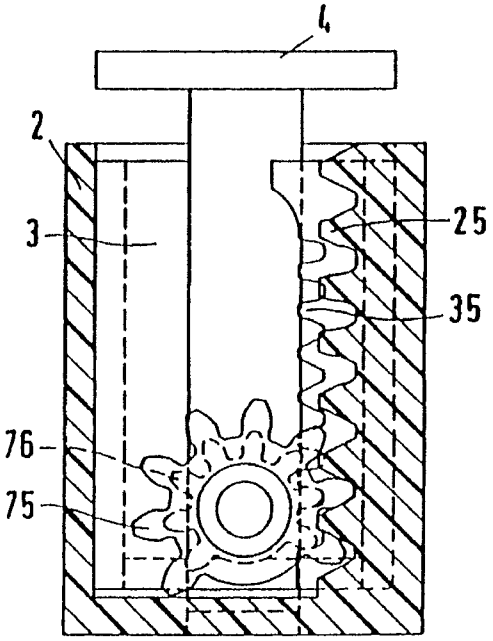
FIGS. 8*a*, 8*b* and 8*c* are partly sectional views of three different phases of the insertion motion of a further embodiment of a plug connector according to the invention.
Figure 8B:
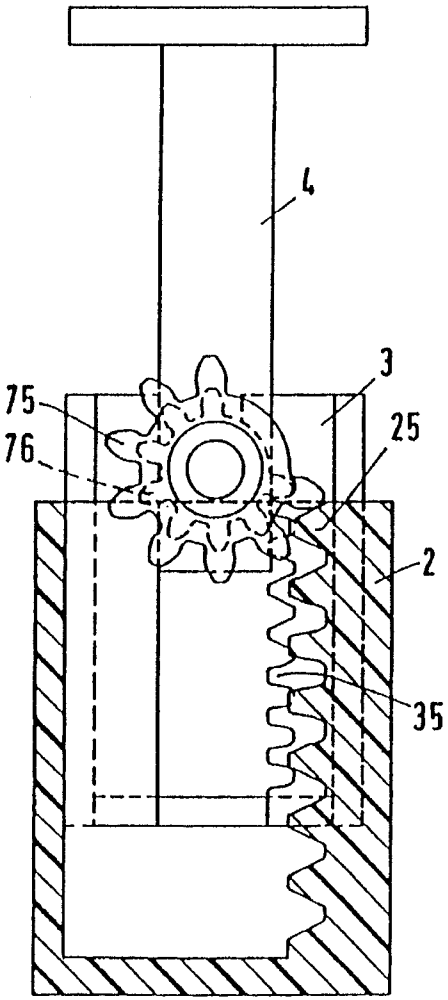
Figure 8A:
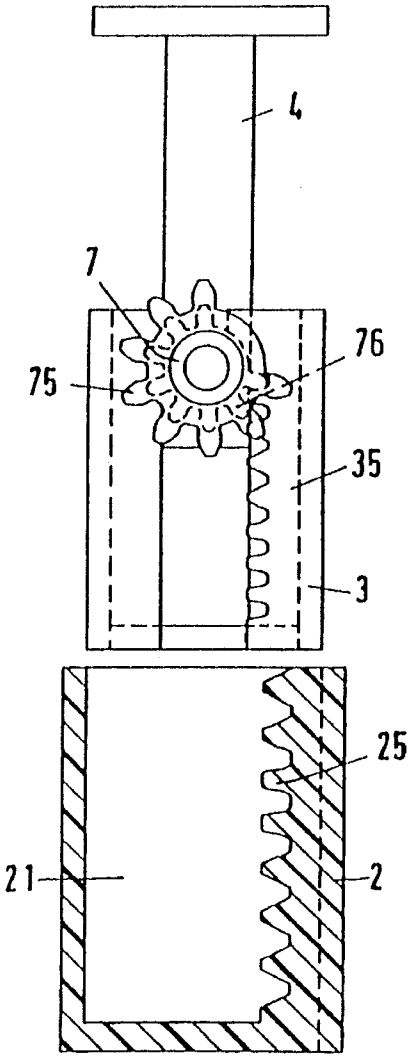

A further exemplary embodiment will be described in conjunction with FIGS. 8*a*–8*c*. In this case, the gear wheel 7 is located on the slide 4, while the plug receptacle 2 has a rack 25 and the plug 3 has a rack 35. The racks 25 and 35 are located on the same side of the gear wheel axis, next to one another, and the gear wheel 7 has toothed rings 75 and 76, each being associated with a respective one of the two racks. Through the use of different pitches of the rack 25 which meshes with the tooth ring 75 on one hand, and the rack 35 which meshes with the tooth ring 76 on the other hand, a desired gear ratio is obtained, in such a way that the tooth ring 75 rolls off the rack 25 faster than the tooth ring 76 rolls off the rack 35. The result is a slowing down of the insertion motion of the plug 3 relative to the insertion motion of the slide 4. As can be seen in the intermediate position of FIG. 8*b* and the terminal position of FIG. 8*c*, from the onset of the insertion motion the slide 4 covers a substantially longer distance than the plug 3, and therefore at the end of the insertion motion both the plug 3 and the slide 4 are inserted all the way into the plug receptacle 2.

The gear ratio can be selected arbitrarily by one skilled in the art. Through suitable dimensioning of the tooth rings of the gear wheel, it can also be taken into account whether the two racks face one another with respect to the axis of rotation of the gear wheel, or are on the same side thereof. A variation in the pitch in the course of the insertion motion could also be produced, although this is not shown, in order to adapt the gear ratio to the insertion forces that arise. This is because these insertion forces are highest when the non-illustrated contact elements mesh with one another completely at the end of the insertion motion.

We claim:

1. An electric plug connector, comprising:

first, second and third housing parts;

one of said housing parts being a plug receptacle for receiving a contact element, said plug receptacle forming a plug channel;

another of said housing parts being a plug for receiving a complementary contact element, said plug having outer contours adapted to said plug channel;

a further of said housing parts being an actuation element in the form of a longitudinally movably guided slide for moving said plug into and out of said plug receptacle; and three sets of teeth each being disposed on a respective one of said housing parts and having a predetermined gear ratio, two of said sets of teeth being racks each being firmly connected to a respective one of said first and second housing parts, and one of said sets of teeth being a gear wheel being rotatably supported on said third housing part for meshing with said two racks.

2. The plug connector according to claim 1, wherein said gear wheel is supported on said plug and meshes with said racks each being disposed on a respective one of said plug receptacle and said slide.

3. The plug connector according to claim 1, wherein said gear wheel is supported on said slide and meshes with said racks each being disposed on a respective one of said plug receptacle and said slide.

4. The plug connector according to claim 3, wherein said gear wheel has two toothed rings with different pitches, for meshing with said racks having corresponding pitches.

5. The plug connector according to claim 1, wherein said sets of teeth have changing pitches resulting in said gear ratio changing in a plug insertion direction.

6. The plug connector according to claim 1, including a detent element disposed on said plug receptacle and a detent element disposed on another of said housing parts, for locking said plug receptacle to said other housing part at an end of an insertion motion.

7. The plug connector according to claim 1, including an additional slide having a set of teeth, said sets of teeth of said slides being disposed on opposite sides of said housing parts.

8. The plug connector according to claim 7, including a yoke interconnecting said slides.

* * * * *